US010767313B2

(12) United States Patent
Kuo et al.

(10) Patent No.: US 10,767,313 B2
(45) Date of Patent: Sep. 8, 2020

(54) METHOD FOR FABRICATING SHAPED PAPER PRODUCTS

(71) Applicant: GOLDEN ARROW PRINTING TECHNOLOGY (KUNSHAN) CO., LTD., Kunshan, Jiangsu Province (CN)

(72) Inventors: Chien-Kuan Kuo, New Taipei (TW); Chun-Huang Huang, New Taipei (TW)

(73) Assignee: GOLDEN ARROW PRINTING TECHNOLOGY (KUNSHAN) CO., LTD., Kunshan, Jiangsu Province (CN)

( * ) Notice: Subject to any disclaimer, the term of this patent is extended or adjusted under 35 U.S.C. 154(b) by 182 days.

(21) Appl. No.: 16/029,541

(22) Filed: Jul. 6, 2018

(65) Prior Publication Data

US 2019/0194870 A1 Jun. 27, 2019

(30) Foreign Application Priority Data

Dec. 27, 2017 (TW) ..... 106219308 U
Jan. 31, 2018 (TW) ..... 107103531 A

(51) Int. Cl.
*D21H 19/82* (2006.01)
*D21H 19/12* (2006.01)
(Continued)

(52) U.S. Cl.
CPC ..... *D21H 19/828* (2013.01); *D21F 13/00* (2013.01); *D21H 19/12* (2013.01); *D21H 19/20* (2013.01);
(Continued)

(58) Field of Classification Search
CPC ..... D21J 3/00; D21J 7/00; D21J 5/00; D21J 3/10; D21H 27/10; D21H 19/12;
(Continued)

(56) References Cited

U.S. PATENT DOCUMENTS 2,813,463 A * 11/1957 Chaplin ..... D21J 5/00 162/377
3,957,558 A * 5/1976 Lee ..... B29C 51/16 156/212
(Continued)

FOREIGN PATENT DOCUMENTS

TW M512495 U 11/2015
TW M522242 U 5/2016
(Continued)

*Primary Examiner* — Jose A Fortuna
(74) *Attorney, Agent, or Firm* — Cheng-Ju Chiang

(57) ABSTRACT

A method for fabricating shaped-paper products is introduced herein, which comprises at least one dredging-pulp step for forming a wet pulp made of paper-slurry materials, at least one pre-compression step for lightly compressing the wet pulp to form a first semi-finished product, at least one thermo-compression forming step for deeply compressing the first semi-finished product to form a second semi-finished product, and a surface-coating step of employing a product surface coating apparatus to coat a liquid coating materials onto at least one outer surface of the second semi-finished product, and thereby forming each of the shaped-paper products having a binding layer. With utilization of the present invention, an automatic coating can be applied high efficiently in a series of continuous production machines. This could not only shorten processing time and benefit a mass production thereof but also ensure a higher production yield and quality.

10 Claims, 7 Drawing Sheets

(51) Int. Cl.

| | |
|---|---|
| ***D21H 19/22*** | (2006.01) |
| ***D21H 19/20*** | (2006.01) |
| ***D21J 3/00*** | (2006.01) |
| ***D21H 19/74*** | (2006.01) |
| ***D21F 13/00*** | (2006.01) |
| ***D21H 23/50*** | (2006.01) |
| ***D21H 27/10*** | (2006.01) |

(52) U.S. Cl.
CPC ..... *D21H 19/22* (2013.01); *D21H 19/74* (2013.01); *D21H 19/82* (2013.01); *D21H 23/50* (2013.01); *D21H 27/10* (2013.01); *D21J 3/00* (2013.01)

(58) Field of Classification Search
CPC ..... D21H 19/20; D21H 19/22; D21H 19/74; D21H 19/82; D21H 19/828; D21H 23/50; D21F 13/00; D21G 9/00
See application file for complete search history.

(56) References Cited

U.S. PATENT DOCUMENTS 4,938,412 A * 7/1990 Genter ..... D21H 23/50 206/521.1
6,245,199 B1 * 6/2001 Lee ..... D21J 7/00 162/382
6,592,720 B1 * 7/2003 Nonomura ..... D21J 3/10 162/220
7,048,975 B1 * 5/2006 Tojo ..... B65D 1/0207 428/213
8,043,539 B2 * 10/2011 Ozasa ..... B29C 43/003 264/319
8,434,958 B2 * 5/2013 Rademacher ..... B05C 11/1013 401/146
9,186,696 B2 * 11/2015 Miyamoto ..... H01L 21/6715
9,650,746 B2 * 5/2017 Kuo ..... D21J 3/12
9,951,478 B2 * 4/2018 Kuo ..... D21J 3/00
9,976,262 B2 * 5/2018 Kuo ..... D21J 3/00
10,113,271 B2 * 10/2018 Gordon ..... D21J 5/00
10,435,848 B2 * 10/2019 Andersson ..... B22F 5/007
2005/0230864 A1 * 10/2005 Ozasa ..... B29C 44/3426 264/102
2007/0227680 A1 * 10/2007 Kim ..... B31D 5/02 162/218
2009/0229773 A1 * 9/2009 Appleford ..... D21J 3/00 162/134
2010/0260531 A1 * 10/2010 Rademacher ..... B05C 5/02 401/146
2012/0276400 A1 * 11/2012 Nilsson ..... D21J 3/00 428/537.1
2015/0204020 A1 * 7/2015 Gordon ..... D21J 5/00 162/109
2015/0298144 A1 * 10/2015 Peleg ..... B05D 1/28 427/428.12
2016/0168793 A1 * 6/2016 Kuo ..... D21J 3/12 162/227
2016/0168801 A1 * 6/2016 Kuo ..... D21J 3/00 162/194
2016/0362845 A1 * 12/2016 Kuo ..... D21J 3/12
2017/0370049 A1 * 12/2017 Andersson ..... B22F 5/007
2019/0048531 A1 * 2/2019 Gordon ..... D21J 3/00
2019/0194870 A1 * 6/2019 Kuo ..... D21H 27/10
2019/0284764 A1 * 9/2019 Kuo ..... D21G 9/00
2019/0376239 A1 * 12/2019 Andersson ..... D21J 3/00

FOREIGN PATENT DOCUMENTS

TW M544995 U 7/2017
WO WO-2015003275 A1 * 1/2015 ..... D21H 19/82
WO WO-2016101976 A1 * 6/2016 ..... D21J 3/00
WO WO-2017146276 A1 * 8/2017 ..... B05B 12/00

* cited by examiner

METHOD FOR FABRICATING SHAPED PAPER PRODUCTS

FIELD OF THE INVENTION

The present invention relates to a method for fabricating shaped-paper products, and more particularly, is related to a method for fabricating shaped-paper products, which is suitable for automated production.

BACKGROUND OF THE INVENTION

Since the 3C electronic products are gaining popularity, presently, their packaging materials, such as paper boxes and internal packing trays, have to provide both features at the same time. One is to have a certain structural strength for protecting those 3C electronic products from external force impacts, and the other is to render their packaging appearance aesthetic, such as exquisitely-made graphic/text printings, so as to promote the purchase desires of the consumers. To accomplish the above-mentioned demands, various kinds of paper-molded processes and their related fabricating machines utilizing a variety of mold assemblies are successively published for to massively producing shaped-paper products.

A conventional shaped-paper (so-called wet-fiber molded paper) process commonly treats waste papers and natural plant fibres (e.g. palms, bagasses, bamboo splites, reeds and set forth) as base materials, which includes: squashing and beating the base materials, pulping by means of dispersing of the water so as to form a wet-fiber pulped body, and next, throughout a number of consistently related fabricating machines, dredging the wet-fiber pulped body, and extruding and heating the dredged pulped body by the upper and lower mold assembly, so as to produce a substrate of the above-mentioned shaped-paper product.

However, since the substrate of the shaped-paper product (e.g. a semi-finished product or a finished product) is primarily constructed of fibers, it will incur the following issues: (1) there are scraps readily falling off surfaces of the substrate of the shaped-paper product to come into fine dusts that are not beneficial to the environment; (2) while the surfaces of the shaped-paper products are ink jetted thereto for graphic/text printing, too-many fibered scraps on the substrate surface often could invoke ink halo or ink penetration matters and so forth, thereby easily causing a graphic/text printing distortion; (3) since paper fibers are involved therewith, it results in a worse surface flatness of the substrate of the shaped-paper product as well as in uneven matter that makes poor aesthetic appearance thereof, and simultaneously results in graphic/text printing distortion when printed; and (4) the substrate surfaces of the shaped-paper product have poor watertightness. Accordingly, for several specific demands, for example, the ones which conforms to characteristics or specifications of the finally-finished product, it is required to pre-treat the substrate surfaces of the shaped-paper product. However, while the traditional wet-fiber paper-molded process with fabricating machines is utilized to produce the shaped-paper products, the fabricating process often needs to be interrupted to handle by a manual manner in a case of processing the substrate of the shaped-paper product (e.g. a semi-finished product) such as a surface-coating processing. This will not only interrupt the process to lower its automated-production efficiency but also easily form an uneven coated layer by way of the manual manner to coat the surface of the shaped-paper product, and thereby lowering its product yields and being not capable to ensuring it product quality.

Therefore, it is essential to provide a method for fabricating shaped-paper products, so as to solve the above-mentioned drawbacks of the prior arts.

SUMMARY OF THE INVENTION

In order to solve the above-mentioned drawbacks of the prior arts, a primary objective of the present invention is to provide a method for fabricating shaped-paper products, which is specifically suitable to a series of continuous production machines for a wet-fiber paper-molded process, with a capability of a high-efficient automatic coating for the shaped-paper products. This could not only save huge processing time and benefit to mass production but also ensure a higher production yield and quality.

Another objective of the present invention is to provide a method for fabricating shaped-paper products, which is used to form a binding layer on at least one outer surface of at least one shaped-paper body of each of the shaped-paper products, wherein the binding layer incorporates the following several technical benefits: (1) the binding layer can eliminate the possibilities of scraps falling off from an outer surface of the at least one shaped-paper body and fine dusts incurred, so as to comfort to a variety of environmental protection standards; (2) while the inkjet is launched as graphic/text printing, the binding layer of the at least one shaped-paper body would not easily result in the ink halo, the ink penetration and set forth, which further cause graphic/text printing distortions; (3) the binding layer is capable of raising an outer-surface flatness of the at least one shaped-paper body, thereby reducing occurrence of uneven-surface matter so as to strengthen its aesthetic appearance; (4) the binding layer is capable of enhancing a surface watertightness of the at least one shaped-paper body; and (5) the binding layer is capable of enhancing an abradability of the outer surface of the shaped-paper products.

To accomplish the above-mentioned objectives, a preferred embodiment of the present invention provides a method for fabricating shaped-paper products, which comprises the following steps: at least one pulp-dredging step which comprises utilizing either of a first upper mold and a first lower mold to dredge up paper-slurry materials, containing wet fibers, within a slurry tank, and thereby forming a wet pulp, constructed of the paper-slurry materials, between the first upper mold and the first lower mold; at least one pre-compression step which comprises implementing a compression mutually between the first upper mold and the first lower mold to be in a closing-mold manner with a light compression on the wet pulp, draining a portion of water vapor and/or moistures contained within the wet pulp, and thereby forming a first semi-finished product; at least one thermo-compression forming step which comprises positioning the first semi-finished product into between a second upper mold and a second lower mold, further implementing a thermo-compression forming on the first semi-finished product mutually between the second upper mold and the second lower mold, draining a portion of water vapor and/or moistures contained within the first semi-finished product, and thereby forming a second semi-finished product; and a surface-coating step which employs a product surface coating apparatus to coat the liquid coating materials onto at least one outer surface of at least one shaped-paper body of the second semi-finished product, for forming each of the shaped-paper products having a binding layer.

In a preferred embodiment of the present invention, the surface-coating step further comprises utilizing a conveying apparatus to movably carry the second semi-finished product to reach the product surface coating apparatus.

In a preferred embodiment of the present invention, the product surface coating apparatus comprises a programmable movement apparatus which has a movable portion, a nozzle unit disposed with the movable portion, and a controlling device. The surface-coating step further comprises that when the movable portion is programmably moved, with bringing the nozzle unit together, along a predetermined spraying path and/or in a moving velocity, with relative to the at least one surface of the at least one shaped-paper body, the nozzle unit atomization-sprays the liquid coating materials onto the at least one surface of the at least one shaped-paper body by adjustable control of the controlling device.

In a preferred embodiment of the present invention, the surface-coating step further comprises at least one sensor generating a notification signal to the programmable movement apparatus and/or the controlling device, for actuating a spraying operation, when sensing that the conveyed second semi-finished product reaches a to-be-sprayed position.

In a preferred embodiment of the present invention, the surface-coating step further comprises employing a drying device to heat-dry the liquid coating materials sprayed on the at least one surface of the at least one shaped-paper body of the second semi-finished product, and thereby forming the binding layer of the respective shaped-paper products.

In a preferred embodiment of the present invention, the at least one shaped-paper body of the second semi-finished product is formed in a three-dimensional stereo-structure.

In a preferred embodiment of the present invention, a composition of the liquid coating materials comprises hydrofluoroether and fluorides.

In a preferred embodiment of the present invention, a composition of the liquid coating materials comprises styrene-acrylate copolymer, polyethylene wax, water, butyl acetate and amine antioxidant.

In a preferred embodiment of the present invention, when a thickness of the binding layer is in a thickness range of 20~200 μm, the binding layer conforms to 3~50 standard-abrasive cycles under a standard abrasive-resistance test using a RCA abrader and defined in ASTM F-2357-04 specification.

In a preferred embodiment of the present invention, the method for fabricating the shaped-paper products further comprises transfer-printing an ink layer onto the binding layer of the respective shaped-paper products by a printing plate wherein the printing plate is one of an intaglio printing plate, a relief printing plate, a screen printing plate and a planographic printing plate.

In a preferred embodiment of the present invention, the method for fabricating the shaped-paper products further comprises transferring a surface treatment film onto the binding layer by a mold assembly.

In a preferred embodiment of the present invention, the surface treatment film comprises a strippable carrier layer, a release layer located on a surface of the carrier layer, a hard coating layer located on a surface of the release layer; a decorative layer located on a surface of the hard coating layer, at least one ink layer, and an adhesive layer located on one of outermost surfaces of the surface treatment film, for adhesion onto the binding layer of the respective shaped-paper products.

In a preferred embodiment of the present invention, the method for fabricating the shaped-paper products further comprises a cutting step that utilizes cutter molds to cut the respective shaped-paper products, for forming a shaped-paper finished product.

Compared with the prior art, the method for fabricating shaped-paper products according to the present invention, is specifically suited to continuous production machines for a wet-fiber paper-molded process, which implements rapid and larger-region spray with the atomized coating materials onto an outer surface of the shaped-paper body, thereby forming an evenly-distributed binding layer. This could save a huge processing time and ensure a higher production yield and quality. Besides, the binding layer formed on the outer surface of the shaped-paper body could not only effectively eliminate the scraps falling off from the outer surface of the shaped-paper body and the possibility of incurring the fine dusts but also raise the overall surface flatness of the shaped-paper body, reduce uneven surface matters, and strengthen its aesthetic appearance; and simultaneously, when a graphic/text printing is applied onto the binding layer, the binding layer does not easily incur distortion matters of the graphic/text printing, such as ink halo, ink penetration and set forth, and is further capable of enhancing watertightness of the outer surface of the shaped-paper body.

DESCRIPTION OF THE DIAGRAMS

DETAILED DESCRIPTION OF THE PREFERRED EMBODIMENTS

The following description of the embodiments is given by way of illustration with reference to the specific embodiments in which the invention may be practiced. The use of any directional term is used to describe and to understand the present invention and is not intended to limit the invention.

Figure 1:
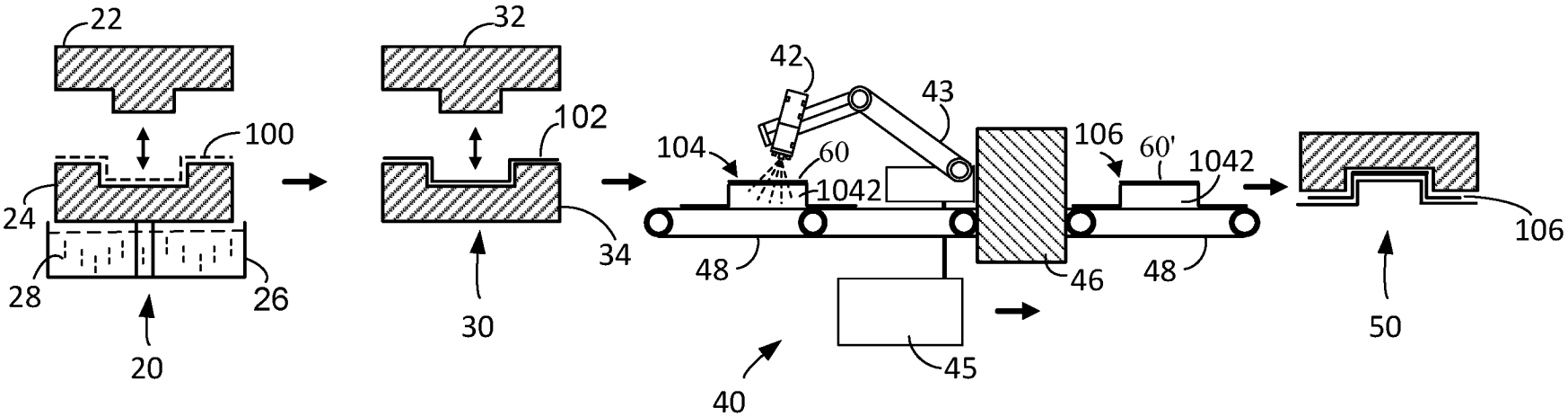
FIG. 1 illustrates an assembly schematic diagram of a product surface coating apparatus of a preferred embodiment according to the present invention, wherein the product surface coating apparatus is disposed among continuously-related automatic production machines according to a wet-fiber paper-molded process.

Please refer to FIG. 1, which illustrates an assembly schematic diagram of a product surface coating apparatus 40 of a preferred embodiment according to the present invention, the product surface coating apparatus 40 is disposed among a series of continuously-related automatic production machines according to a wet-fiber paper-molded process. The continuously-related automated production machines for the wet-fiber paper-molded process primarily comprises a pulp-dredging and pre-compression apparatus 20, a thermo-compression forming apparatus 30, the product surface coating apparatus 40, and a product cutting apparatus 50, wherein the pulp-dredging and pre-compression apparatus 20 provides a first lower mold 24 for dredging up paper-slurry materials, containing wet fibers 100, within a slurry tank 26 storing slurries 28, so as to form a wet pulp (not shown), constructed of the paper-slurry materials 100, on an inner surface of the first lower mold 24. However, this does not therefore limit a structure of a pulp-dredging and pre-compression assembly for dredging up the paper-slurry materials 100 containing natural fibers. In other embodiments, it may be altered with using a surface of a first upper mold 22 to make the wet pulp formed thereon. Next, in the pulp-dredging and pre-compression apparatus 20, a pre-compression is implemented mutually between the first upper mold 22 and the first lower mold 24 to be in a closing-mold manner with lightly compacting the wet pulp between the first upper mold 22 and the first lower mold 24, and by exhausting air between both the molds 22, 24, a vacuum environment is created with draining a portion of water vapor and/or moistures contained within the wet pulp, thereby forming a first semi-finished product 102. The thermo-compression forming apparatus 30 is used for implementing a thermo-compression forming on the first semi-finished product 102 mutually between a second upper mold 32 and a second lower mold 34 in another closing-mold manner with a deeper heating-compression on the first semi-finished product 102 as compacted, draining a portion of water vapor and/or moisture contained within the first semi-finished product 102, and thereby forming a dried second semi-finished product 104. However, this is not therefore limited to only one thermo-compression forming apparatus 30 used for thermo-compression forming or for only one-time compression. In other embodiments, there are several additional thermo-compression forming apparatuses which can be used to dividedly implement the pre-compression and thermo-compression forming operations in several divisions, or the same thermo-compression forming apparatus 30 is used to dividedly implement the pre-compression and thermo-compression forming operations for many times. In this preferred embodiment, the product surface coating apparatus 40 (its structure will be detailed later) depends on machining sequence of the wet-fiber paper-molded process to interconnect between the thermo-compression forming apparatus 30 and the product cutting apparatus 50, and is used to implement an operation of coating the liquid coating materials 60 onto at least one outer surface of at least one shaped-paper body 1042, constructed with fibers, in the second semi-finished product 104, so as to benefit consequentially forming a third semi-finished product 106 having a binding layer 60' which is formed by coating the liquid coating materials 60. The product cutting apparatus 50 utilizes a number of cutter molds to cut the third semi-finished product 106 in a trimming manner, thereby forming a shaped-paper finished product 108. Please note that the above-mentioned first semi-finished product 102, the second semi-finished product 104, the third semi-finished product 106 described herein can be generally called a 'shaped-paper product'. However, in other embodiments, said 'shaped-paper product' is not therefore limited to a semi-finished product as well as a shaped-paper finished product owing to depending on the other applications or demand respects. In other embodiments, depending upon different demands on different shaped-paper products, a machining sequence of the product surface coating apparatus 40 can be altered to ahead collocate before the thermo-compression forming apparatus 30 or to laggingly collocate behind the product cutting apparatus 50.

In other embodiments, the shaped-paper body 1042 of the shaped-paper product 106 according to the present invention can also adopt other prior shaped-paper forming technology for mass production. Actually, the only need is to incorporate various kinds of mass production machines, which is required for the conventional shaped-paper forming technology, with the product surface coating apparatus 40, so as to arrange in the same automated production line. The shaped-paper product 106 can be shaped in a shape of various kinds of three-dimensional geometric structure, such as a pack body, a cubed body, a triangle body, a rectangular body, a trapezoid body, a pyramided body, a cylinder and set forth, which is not specially limited thereto.

Figure 2:
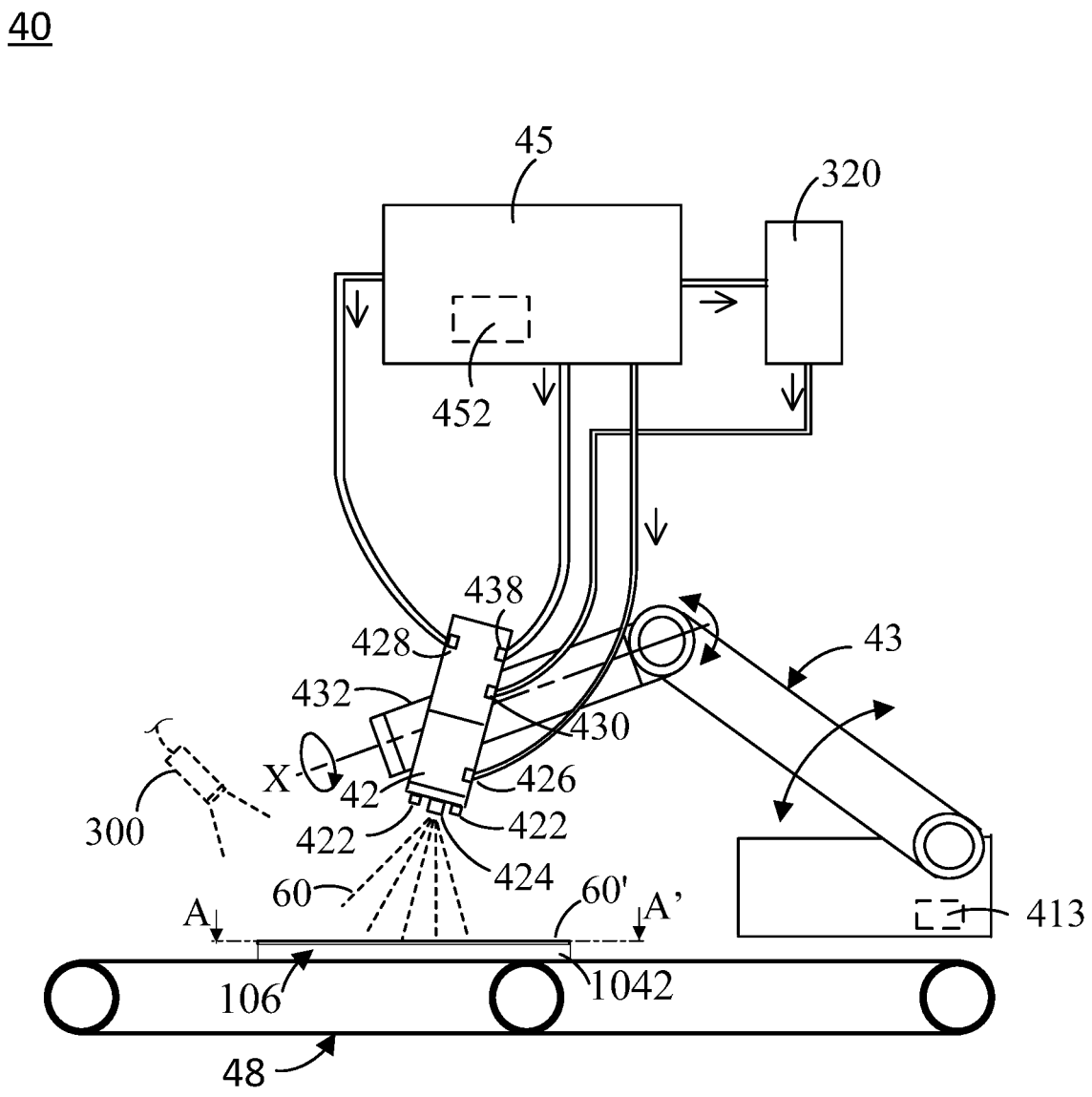
FIG. 2 illustrates a detailed assembly schematic diagram according to the product surface coating apparatus shown in FIG. 1.

Please further refer to the product surface coating apparatus 40 of the preferred embodiment according to the present invention, as shown in FIGS. 1 and 2, which is primarily structured with a nozzle unit 42, a programmable movement apparatus 43 and a controlling device 45. By coordination controls among the nozzle unit 42, the programmable movement apparatus 43 and the controlling device 45, in the product surface coating apparatus 40 of the present invention, the product surface coating apparatus 40 is capable of rapidly and larger-regionally spraying the atomized coating material 60 onto an outer surface of the shaped-paper body 1042 of the shaped-paper product 104 to save its huge processing time, thereby forming an evenly-distributed binding layer 60' and ensuring a higher production yield and quality.

The programmable movement apparatus 43 comprises a movable portion having a joint terminal 432 thereon which is configured with releasable connection with the nozzle unit 42, wherein the joint terminal may be a conventionally-known part, such as a clamping assembly, a hooking assembly or a screwing assembly and set forth. In the preferred embodiment, the programmable movement apparatus 43 is an electrically driven multi-axis robot arm having multiple mechanical joints, a programmable logic controller 413, and a servo mechanism (not shown) such as motors and/or hydraulic cylinders. The programmable logic controller 413 is configured to programmably control the movement of the movable portion 432 via the servo mechanism, along a predetermined spraying path and/or in a moving velocity, with relative to the at least one surface of the at least one shaped-paper body 1042. The robot arm utilizes linkages of the multiple mechanical joints to allow the movable portion 432 moving in a plane, a three-dimensional space or linearity. Besides, the movable portion 432 is further pivoted on a central axis 'X' of one of mechanical joints, thereby leading the nozzle unit 42 to increase its swinging angle as well as widening its spraying magnitude.

The nozzle unit 42 has at least one outer nozzle head 424, at least one gas-pressure control valve 426 and at least one liquid coating materials inlet 430 fluid-communicated to the at least one outer nozzle head 424. And, the nozzle unit 42 is disposed on the joint terminal of the programmable movement apparatus 40, thereby moving with the movable portion 432 together along the predetermined spraying path and/or in the moving velocity. The at least one gas-pressure control valve 426 is configured to control the at least one outer nozzle head 424 outwardly spraying the liquid coating materials 60 onto the at least one surface of the at least one shaped-paper body 1042. In this preferred embodiment, the at least one outer nozzle head 424 of the nozzle unit 42 remains in a distance range of 20-30 cm from the at least one surface of the at least one shaped-paper body 1042; and preferably is 26 cm. When an approximate caliber of the at least one outer nozzle head 424 is 1.3 mm, the at least one outer nozzle head 424 has an approximate spraying-width range of 200~250 mm for each time. However, in another preferred embodiment of the present invention, when an approximate caliber of the at least one outer nozzle head 424 is 1.3 mm, the at least one outer nozzle head 424 has a spraying-width range of 250~270 mm per each time. However, in another preferred embodiment of the present invention, when an approximate caliber of the at least one outer nozzle head 424 is 1.1 mm, the at least one outer nozzle head 424 has a spraying-width range of 150~170 mm per each time. However, please note that descriptions of the above preferred embodiment do not therefore define a protective scope claimed by the present invention. Depending upon different kinds of the at least one outer nozzle head 424, their structures and setting parameters (such as their spraying-width ranges) will differ from each other. In this preferred embodiment, the liquid coating materials 60 have a viscosity range of less than 3,500 cps that does not therefore define a claimed scope of the present invention.

The liquid coating materials 60 of the present invention comprise one or combination of several of compound, polymer and copolymer. In a preferred embodiment of the present invention, a composition of the liquid coating materials 60 comprises, for example, hydrofluoroether (with a content of 90~99 wt %) and fluorides (with a content of 1%~10 wt %). In another preferred embodiment of the present invention, a composition of the liquid coating materials 60 comprise styrene-acrylate copolymer (with a content of approximate 28 wt %), polyethylene wax (with a content of approximate 2 wt %), and water, butyl acetate and amine antioxidant (with a combined content of approximate 70 wt %). However, the aforementioned chemical compositions and their respective contents do not therefore limit thereto a protective scope claimed by the present invention. In other embodiments, the present invention may can use of the liquid coating materials 60 having different composition and/or different content.

As the respective directional arrows indicated in FIG. 2, the controlling device 45 provides a storage-under-pressure vessel 320 for storing the liquid coating materials 60, with a certain gas pressure, and thereby facilitate the storage-under-pressure vessel 320 supplying a liquid-pressurized liquid coating materials source into the at least one liquid coating materials inlet 430 of the nozzle unit 42. And, the controlling device 45 further has at least one controller 452 which is configured for adjustably controlling a gas pressure of a controllable first gas-pressure source connected to the gas-pressure control valve 426, and is configured for adjustably controlling a gas pressure of the liquid coating materials source from the storage-under-pressure vessel 320 fluid-communicated to the at least one liquid coating materials inlet 430 of the nozzle unit 42, thereby adjustably controlling a flow rate of the liquid coating materials 60 that the at least one outer nozzle head 424 sprays. In the preferred embodiment of the present invention, the at least one controller 452 is a programmable logic controller but does not therefore limit a type of the at least one controller 452 thereto. Please note that, in the preferred embodiment of the present invention, a contrast relationship (such as a specific proportional relationship), which is adjustable relatively to among a certain moving velocity where the nozzle unit 42 moved with the movable portion 432 together, the gas pressure of the first gas-pressure source needed by the nozzle unit 42, and the gas pressure of controlling the liquid coating materials source, can be accomplished with an optimally interspersing and spraying efficiency. in a case, when the nozzle unit 42 and the movable portion 432 are set by the programmable movement apparatus 43 to move in a faster moving velocity, the gas pressure of the first gas-pressure source needed by the nozzle unit 42 and the gas pressure of controlling the liquid coating materials source need to be set higher by the controlling device 45 relatively, so as to increase a flow of spraying the liquid coating materials 60. In another contrary case, when the moving velocity of both the nozzle unit 42 and the movable portion 432 is set slower by the programmable movement apparatus 43, the gas pressure of the first gas-pressure source needed by the nozzle unit 42 and the gas pressure of controlling the liquid coating materials source need to be set lower by the controlling device 45 relatively, so as to lower a flow rate of spraying the liquid coating materials 60, thereby accomplishing a balance required for the optimally interspersing and spraying efficiency. Thus, the nozzle unit 42, the programmable movement apparatus 43 and the controlling device 45 disposed within the product surface coating apparatus 40 can depend on different product dimensions and specification to be programmably set, thereby implementing the required automated production.

In the preferred embodiment of the present invention, the gas pressure of the first gas-pressure source is less than 250 kpa; and preferably, is 0.2 Mpa; the gas pressure of controlling the liquid coating materials source is less than 300 kpa; and preferably, is 0.1 Mpa. However, in other embodiments, depending upon different kinds of the at least one outer nozzle head 424, their structures and setting parameters (such as the respective gas pressures) will be different from each other but do not therefore define a claimed scope of the present invention.

Furthermore, as shown in FIGS. 1 and 2, in the preferred embodiment of the present invention, the nozzle unit 42 further has a first atomized gas-pressure inlet 428 which is configured to make the at least one outer nozzle head 424 atomizing and spraying the liquid coating materials 60 onto the at least one surface of the at least one shaped-paper body 1042. And, the at least one controller 452 of the controlling device 45 is configured to further adjustably control a gas pressure of a first atomized gas-pressure source connected to the first atomized gas-pressure inlet 428. In a preferred embodiment of the present invention, the gas pressure of the first atomized gas-pressure source is larger than 100 kpa but is less than 10.42 Mpa; and preferably, is 0.1 Mpa. However, in other embodiments, depending upon different kinds of the at least one outer nozzle head 424, their structures and setting parameters (such as the respective gas pressures) will be different from each other but do not therefore define a claimed scope of the present invention.

Furthermore, as shown in FIGS. 1 and 2, in the preferred embodiment of the present invention, the nozzle unit 42 further has a number of atomizing nozzle heads 422 closer to a periphery of the nozzle unit 42 and a second atomized gas-pressure inlet 438, wherein the number of atomizing nozzle heads 422 is further capable of enlarging a spraying magnitude (or called 'width margin') of spraying the liquid coating materials 60 as well as being capable of atomizing and spraying the liquid coating materials 60 onto the at least one surface of the at least one shaped-paper body 1042. The at least one controller 452 of the controlling device 45 is configured to further adjustably control a gas pressure of a second atomized gas-pressure source connected to the second atomized gas-pressure inlet 438. In a preferred embodiment of the present invention, the gas pressure of the second atomized gas-pressure source is larger than 150 kpa; and preferably, is 0.3 Mpa. However, in other embodiments, depending upon different kinds of the atomizing nozzle heads 422, their structures and setting parameters (such as the respective gas pressures) will be different from each other but do not therefore define a claimed scope of the present invention.

Furthermore, as shown in FIGS. 1 and 2, in the preferred embodiment of the present invention, the product surface coating apparatus 40 further comprises a conveying apparatus 48, such as a conveyor for production line, which is configured to movably carry the at least one shaped-paper body 1042 of the shaped-paper product 104, 106 between the thermo-compression forming apparatus 30 and the product cutting apparatus 50. The product surface coating apparatus 40 further comprises a sensor 300 which is configured to generate a notification signal to the programmable movement apparatus 43 and/or the controlling device 45, for actuating a spraying operation, as long as sensing a manner that the at least one shaped-paper body 1042 conveyed by the conveying apparatus 48 reaches a to-be-sprayed position. In this preferred embodiment, the product surface coating apparatus 40 further comprises a drying device 46, such as a drying tunnel, which is configured to heat-dry the liquid coating materials 60 sprayed on the at least one surface of the at least one shaped-paper body 1042, thereby forming a hardened and flatted binding layer 60' on the at least one surface of the at least one shaped-paper body 1042 (shown in FIG. 1). In the preferred embodiment, a drying temperature of the drying device 46 approaches 100 degrees in a centigrade scale; and preferably, is 60 degrees in the centigrade scale, a drying cycle time is 20 seconds. However, this does not therefore limit a protective scope claimed by the present invention thereto because in other embodiment, the present invention can also employ the drying device 46 having different specification.

Figure 3:
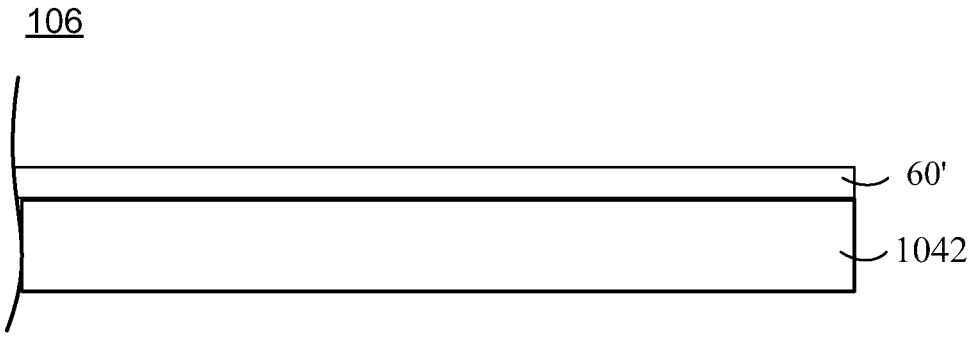
FIG. 3 illustrates a partially cross-sectional view according to a section line A-A' on the shaped-paper product of FIG. 2, wherein the shaped-paper product is produced by the product surface coating apparatus of the preferred embodiment according to the present invention.

Please further refer to FIG. 3, which illustrates a partially cross-sectional view according to a section line A-A' on the shaped-paper product 106 of FIG. 2; thereamong, the shaped-paper product 106 is produced by the product surface coating apparatus 40 of the preferred embodiment according to the present invention. In the above-mentioned respective preferred embodiments, the shaped-paper product 106 comprises said at least one shaped-paper body 1042, and the binding layer 60' formed on the at least one surface of the at least one shaped-paper body 1042 after the liquid coating materials 60 sprayed onto the at least one surface of the at least one shaped-paper body 1042 by the product surface coating apparatus 40 is dried and hardened. By way of formation of the binding layer 60' after drying and hardening, it could not only effectively decrease the scraps falling off from the surface of the at least one shaped-paper body 1042 and a possibility of incurring fine dusts but also elevate a surface flatness of the at least one shaped-paper body 1042, reduce uneven-surface matters, strengthen its aesthetic appearance and the overall structural strength, and further enhance a surface watertightness of the at least one shaped-paper body 1042. Understandingly, the present invention can use any liquid coating materials 60 having different compositions in different contents, which can accomplish the following-required technical benefits: when the binding layer 60' formed with the liquid coating materials 60 has a thickness in a thickness range of 20~200 μm, the binding layer 60' conforms to 3~50 standard-abrasive cycles under a standard abrasive-resistance test using "RCA" abrader and defined in ASTM F-2357-04 specification.

In a practical case, a standard abrasive-resistance test, with using a 'RCA' abrader, conforming to ASTM F-2357-04 specification, is applied for a surface of the binding layer 60' of the shaped-paper product 106 according to the present invention, test conditions of the standard abrasive-resistance test includes that: using a RCA abrasion wear tester (as so-called 'RCA abrader') launched by 'Norman Tool Inc.' using RCA standard abrasion test paper having a constant roughness; applying a pressure of weights 55 g onto an under-test outer surface of the binding layer 60' of the shaped-paper product 106; next, constant-speed rolling the RCA standard abrasion test paper to correspondingly abrade the under-test outer surface of the binding layer 60' of the shaped-paper product 106, and simultaneously counting the number of abrasive cycles (or called 'number of cycles') between both thereof until a visible wear manner appears in the under-test outer surface of the binding layer 60', such as a little of fiber scraps appear. By utilizing the standard abrasive-resistance test using RCA Abrader and defined in the ASTM F-2357-04 specification, the RCA abrasion wear tester finds out that: when the binding layer 60' of the shaped-paper product 106 is in the thickness range of 20~200 μm, its RCA standard-abrasion cycle values are counted in 3~50 cycles as well as the wear manner appears. Generally speaking, one RCA standard-abrasion cycle value is probably equivalent to an abrasion result from a human finger pressing a device and test (such as keypads of a keyboard) for 10,000 times. As accordingly found, the binding layer 60' of the shaped-paper product 106 produced by the product surface coating apparatus 40 of the present invention has a great abradability, without an ease of fuzz with fiber scraps.

Figure 4:
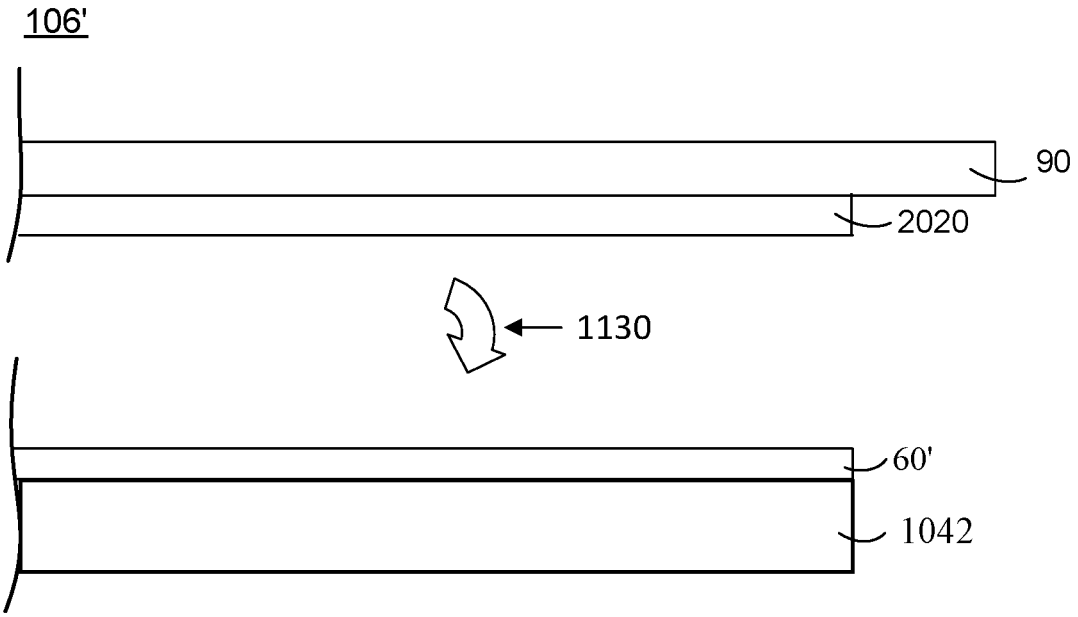
FIG. 4 illustrates a partially cross-sectional view of a shaped-paper product of another preferred embodiment according to the present invention, wherein inks are transfer-printed by a printing plate onto a binding layer of a shaped-paper body.

Referring to FIG. 4, which illustrates a partially cross-sectional view of a shaped-paper product 106' of another preferred embodiment according to the present invention. The shaped-paper product 106' comprises a shaped-paper body 1042, a binding layer 60' formed on an outer surface of the shaped-paper body 1042 (Please refer to the previously-mentioned respective embodiments) and an ink layer 2020 located on an outer surface of the binding layer 60'. With utilization of the prior printing art (or called a 'solvent transfer' technology 1130) which treats a printing plate 90 as a media, the ink layer 2020 originated on a surface of the printing plate 90 containing solvents is transfer-printed by way of a thermo-compression approach onto the outer surface of the binding layer 60' of the shaped-paper body 1042. In this preferred embodiment, the printing plate 90 is one of an intaglio printing plate, a relief printing plate, a screen printing plate and a planographic printing plate. The solvents include water-based and oil-based solvents.

Figure 5:
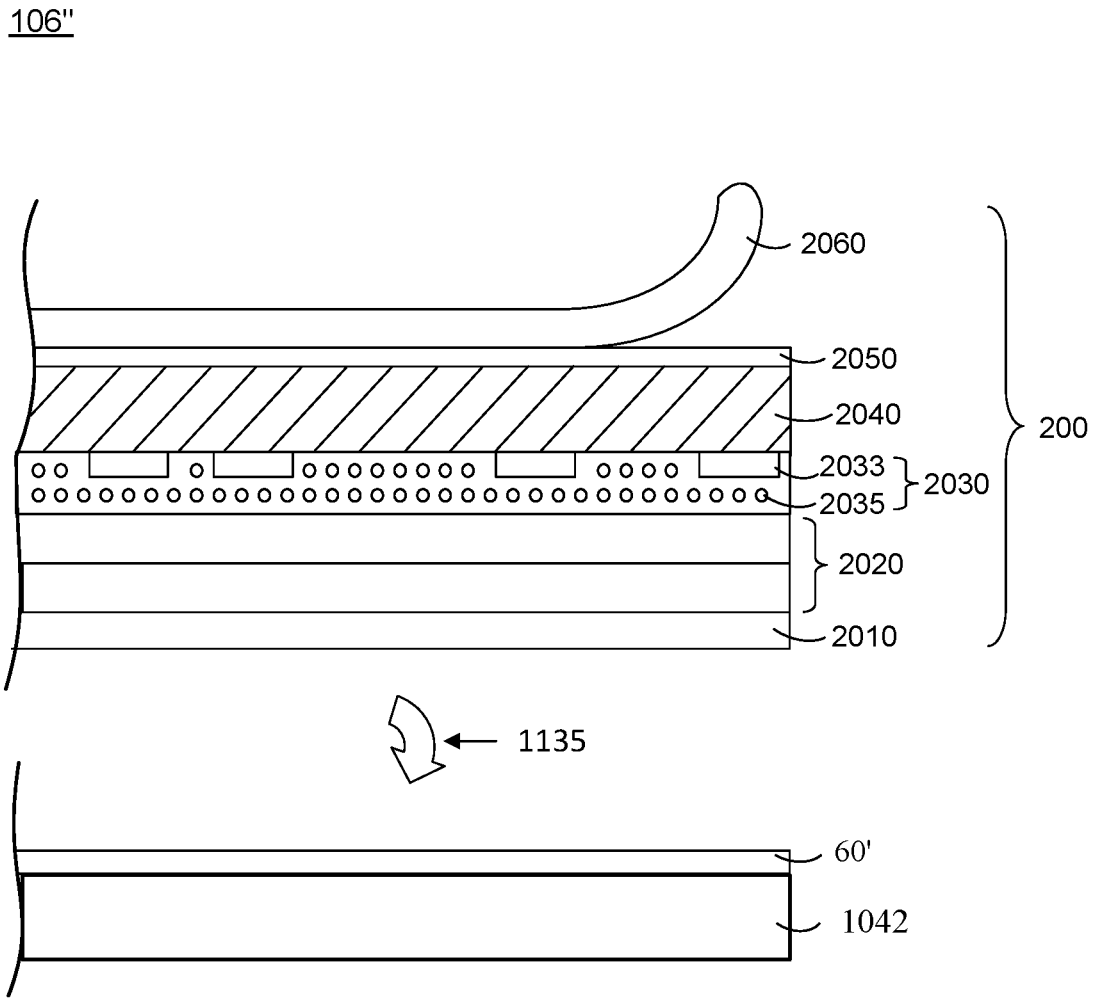
FIG. 5 illustrates a partially cross-sectional view of a shaped-paper product of another preferred embodiment according to the present invention, wherein a surface treatment film is transfer-printed onto a binding layer of a shaped-paper body.

Referring to FIG. 5, which illustrates a partially cross-sectional view of a shaped-paper product 106' of another preferred embodiment according to the present invention, wherein a surface treatment film is transfer-printed onto a binding layer of a shaped-paper body. The shaped-paper product 106' comprises a shaped-paper body 1042, a binding layer 60' formed on an outer surface of the shaped-paper body 1042 (Please refer to the previously-mentioned respective embodiments) and a surface treatment film 200 located on an outer surface of the binding layer 60'. In this preferred embodiment, the surface treatment film 200 and said shaped-paper product 106' both are put in between a mold assembly (not shown) such as paired convex mold and concave mold, and then by way of thermo-compression approach, the surface treatment film 200 is transferred (or called a 'substrate transfer' technology 1135) onto the outer surface of the binding layer 60' of the shaped-paper body 1042.

In this preferred embodiment, the surface treatment film 200 primarily comprises a strippable carrier layer 2060, a release layer 2050 located on a surface of the carrier layer 2060, a hard coating layer 2040 located on a surface of the release layer 2050, at least one ink layer 2020, a decorative layer 2030 located between the hard coating layer 2040 and the at least one ink layer 2020, and an adhesive layer 2010 located on one of outermost surfaces of the surface treatment film 200 and configured to adhere the surface treatment film 200 onto the binding layer 60' of the at least one shaped-paper body 1042. Thereamong, the release layer 2050, the hard coating layer 2040, the decorative layer 2030, the at least one ink layer 2020 and the adhesive layer 2010 are sequentially formed onto a lower surface of the carrier layer 2060. After the surface treatment film 200 is adhered onto the outer surface of the binding layer 60' by the adhesive layer 2010, the carrier layer 2060 is stripped from said shaped-paper product 106' of the surface treatment film 200 by an auxiliary of the release layer 2050. The hard coating layer 2040 is used to protect the at least one ink layer 2020 and the decorative layer 2030.

In this preferred embodiment, the material of the carrier layer 2060 is selected from the group consisting of polyethylene terephthalate (as so-called 'PET'), polymethyl methacrylate (as so-called 'PMMA'), polycarbonate (as so-called 'PC') and polystyrene (as so-called 'PS'); and preferably, the carrier layer 30 is constructed of polyethylene terephthalate (as 'PET'), and a preferable thickness of the carrier layer 30 is in a range from 40 μm to 80 μm. However, this does not therefore define a claimed scope of the present invention.

In this preferred embodiment, the hard coating layer 2040 can be used as a protective layer, an embossed decorative layer and/or a patterned layer (the patterned layer has relief patterns, such as macro structural relief patterns, diffraction type relief patterns or hologram patterns). The hard coating layer 2040 can be an UV-cured hard coating layer, or a heat-cured hard coating layer containing thermosetting resins which are heating-hardened before transfer-printing. The thermosetting resin consists of, for example, at least one of epoxy resin, melamine resin, and polyurethane resin. However, this does not therefore define a claimed scope of the present invention.

In this preferred embodiment, the at least one ink layer 2020 is constructed of one of or combination of several of traditional inks, soy inks, heat-sensitive inks, pressure-sensitive inks or electrically conductive inks, and the adhesive layer 201 is constructed of a polymer adhesive. However, this does not therefore define a claimed scope of the present invention.

In this preferred embodiment, the decorative layer 2030 further comprises a first decorative structure 2033 and a second decorative structure 2035 which is different from the first decorative structure 2033 and disposed in a layer-stack manner with the first decorative structure 2033. In this preferred embodiment, the first decorative structure 2033 is formed with a number of stereo-structures therein, such as concave structures, which are deployed within the first decorative structure 2033. However, this does not therefore limit a shape of the stereo-structures of the first decorative structure 2033 thereto; actually, various kinds of stereo-structures with a capability of condensation, light-reflection or light-refraction can be used. In his preferred embodiment, the second decorative structure 2035 is formed with a number of light-reflectible pearlitic structures therein. However, this does not therefore limit a shape of the structures within the second decorative structure 2035 thereto. Actually, various kinds of structure with a capability of condensation, light-reflection or light-refraction can be used.

Regardless of said 'printing-transfer' technology 1130 indicated in FIG. 4 or said 'substrate (or film) transfer' technology 1135 indicated in FIG. 5, the inks for graphic/text printing is transferred onto the outer surface of the binding layer 60 of the shaped-paper body 1042 of the shaped-paper product 106, 106', the formation of the binding layer 60' can flatten the outer surface of the shaped-paper body 1042 that is uneven originally, thereby elevating a flatness of the outer surface of the shaped-paper body 1042, and preventing graphic/text printing from incurring distortion matters, such as ink halo, ink penetration and set forth.

Figure 6:
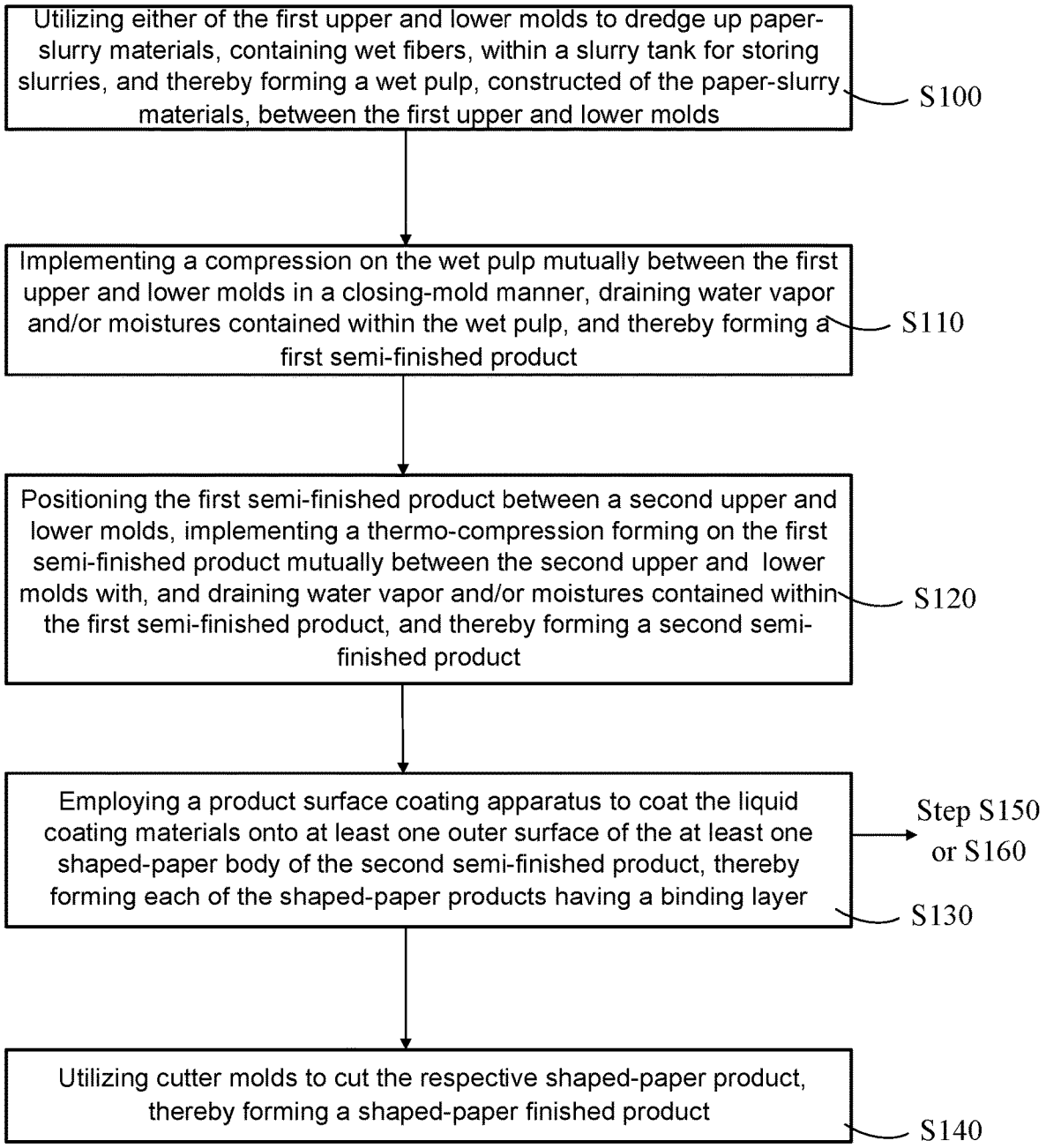
FIG. 6 illustrates a flow chart of a method for fabricating shaped-paper products, in a preferred embodiment according to the present invention.

Please further refer to FIG. 6, which illustrates a flow chart of a method for fabricating shaped-paper products, in a preferred embodiment according to the present invention. Since the method for fabricating shaped-paper products according to the present invention is applied in compliance with the continuous production machines (as shown in FIGS. 1 and 2) for the wet-fiber paper-molded process, the variety of component structures and functions thereof mentioned in the method all can be referred to the aforementioned embodiments shown in FIGS. 1~5 by the reference numerals, and therefore their related details will be omitted below. The method for fabricating shaped-paper products comprises the following steps:

at least one pulp-dredging step S100 which comprises utilizing either of the first upper mold 22 and the first lower mold 24 of the pulp-dredging and pre-compression apparatus 20 (see FIG. 1) to dredge up paper-slurry materials, containing wet fibers 100, within a slurry tank 26 for storing slurries 28, thereby forming a wet pulp, constructed of the paper-slurry materials 100, between the first upper mold 22 and the first lower mold 24;

at least one pre-compression step S110 which comprises implementing a compression mutually between both the first upper mold 22 and the first lower mold 24 of the pulp-dredging and pre-compression apparatus 20 to be in a closing-mold manner with a light compression on the wet pulp, draining a portion of water vapor and/or moistures contained within the wet pulp, and thereby forming a first semi-finished product 102. However, please note that, in other embodiments, the at least one pre-compression step S110 can be implemented by different apparatus, for lightly compressing the wet pulp in the closing-mold manner, and therefore does not limit the present invention to use the first upper mold 22 and the first lower mold 24 of the pulp-dredging and pre-compression apparatus 20 for pre-compressing the wet pulp.

At least one thermo-compression forming step S120 which comprises positioning the first semi-finished product 102 between the second upper mold 32 and the second lower mold 34 of the thermo-compression forming apparatus 30 (see FIG. 1), further implementing a thermo-compression forming on the first semi-finished product 102 mutually between the second upper mold 32 and the second lower mold 34 in another closing-mold manner with a deeper heating-compression, draining a portion of water vapor and/or moistures contained within the first semi-finished product 102, and thereby forming a second semi-finished product (or called 'shaped-paper product') 104. However, please note that, in other embodiments, the at least one thermo-compression forming step S120 can comprise several-times thermo-compression forming steps with different compression depths, which can be respectively implemented by the same thermo-compression forming apparatus 30 or a few of thermo-compression forming apparatus. Thus, this does not therefore limit a protective scope claimed by the present invention. In the preferred embodiment of the present invention, the second semi-finished product 104 of the at least one shaped-paper body 1042 is shaped in a three-dimensional stereo-structure, such as a pack body, a cubed body, a triangle body, a rectangular body, a trapezoid body, a pyramided body, a cylinder and set forth, which is specially limited thereto; and a surface-coating step S130 which comprises employing the product surface coating apparatus 40 to coat the liquid coating materials 60 onto at least one outer surface of the at least one shaped-paper body 1042 of the second semi-finished product 102, thereby forming a third semi-finished product (or called a 'shaped-paper product') 106 with the binding layer 60' (as shown in FIGS. 1 and 2). Please note that, the first semi-finished product 102, the second semi-finished product 104, the third semi-finished product 106 above-mentioned all are generally called 'shaped-paper product'. However, in other embodiments, said 'shaped-paper product' is not therefore limited to a semi-finished product since possibly used as a shaped-paper finished product in another respect for other applications or client demands.

Figure 7:
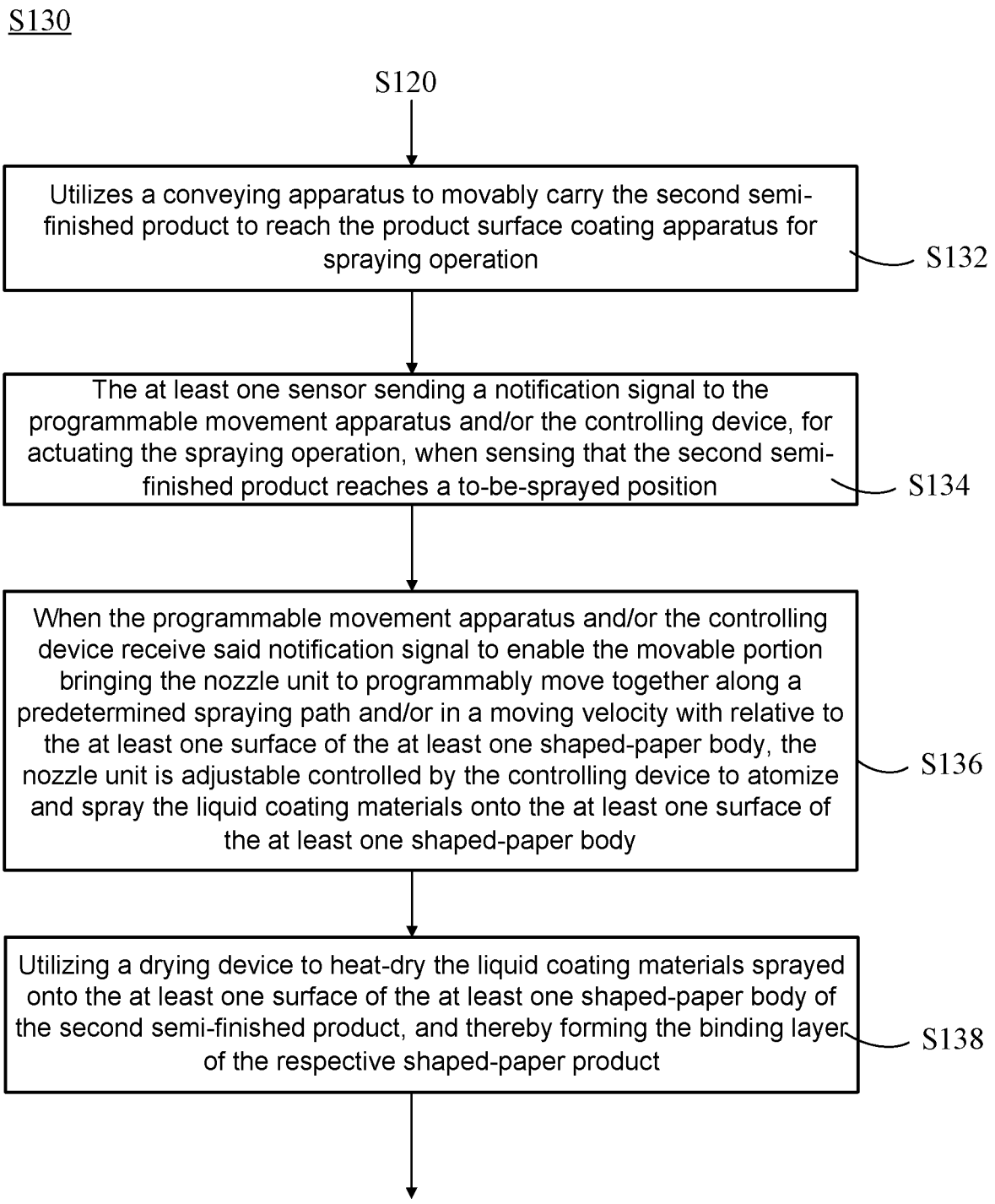
FIG. 7 illustrates a flow chart of detail steps included in the surface-coating step of the method for fabricating shaped-paper products, in the preferred embodiment according to the present invention.

Please further refer to FIG. 7, which illustrates a flow chart of detail steps included in the surface-coating step S130 of the method for fabricating the shaped-paper products, in the preferred embodiment according to the present invention. In this preferred embodiment of the present invention, the surface-coating step S130 further comprises a step S132 which utilizes the conveying apparatus 48 to movably carry the second semi-finished product 104 to reach the product surface coating apparatus 40 for spraying operation (as shown in FIG. 1). However, this does not therefore limit the present invention since the step S132 may be omitted depending on different applications or deployments in another embodiment.

As shown in FIG. 7, in a preferred embodiment of the present invention, by the product surface coating apparatus 40 (as shown in FIGS. 1 and 2) of the first preferred embodiment according to the present invention, the surface-coating step S130 further comprises a step S134 which comprises the at least one sensor 300 generating a notification signal to the programmable movement apparatus 43 and/or the controlling device 45, for actuating the spraying operation, when sensing that the second semi-finished product 104 (via the movably carrying of the above-mentioned conveying apparatus 48) reaches a to-be-sprayed position. However, this does not therefore limit the present invention since the step S134 may be omitted depending on different applications or deployments in another embodiment.

As shown in FIG. 7, in a preferred embodiment of the present invention, by the product surface coating apparatus 40 (as shown in FIGS. 1 and 2) of the first preferred embodiment according to the present invention, the surface-coating step S130 further comprises a step S136 which comprises that, when the programmable movement apparatus 43 and/or the controlling device 45 of the product surface coating apparatus 40 receive said notification signal to enable the movable portion 432 bringing the nozzle unit 42 together to programmably move along a predetermined spraying path and/or in a moving velocity, with relative to the at least one surface of the at least one shaped-paper body 1042, the nozzle unit 42 is adjustable controlled by the controlling device 45 to atomize and spray the liquid coating materials 60 onto the at least one surface of the at least one shaped-paper body 1042. In the detail, the controlling device 45 is capable of adjustably controlling the gas pressure of the first gas-pressure source of the nozzle unit 42 and adjustably controlling the gas pressure of the liquid coating materials 60, so as to atomize and spray the liquid coating materials 60 onto the at least one surface of the at least one shaped-paper body 1042. In the preferred embodiment of the present invention, the gas pressure of the first gas-pressure source is less than 250 kpa; and preferably, is 0.2 Mpa. The gas pressure of the liquid coating materials 60 is controlled less than 300 kpa; and preferably, is 0.1 Mpa. However, this does not therefore limit a protective scope claimed by the present invention thereto since in other embodiment, the present invention can also employ the other nozzle unit 42 having different specification or different structure, such as one having multiple outer nozzle heads 422, 424 and/or multiple first atomized gas-pressure inlets 428, 438 (as shown in FIGS. 1 and 2), so as to regulate an atomizing and spraying flow of the liquid coating materials 60. Please note that, in the preferred embodiment of the present invention, it is necessary to accomplish a contrast relationship (as a specific proportional relationship) adjustable relatively to among the moving velocity where the nozzle unit 42 and the movable portion 432 move together, and the gas pressure of the first gas-pressure source needed by the nozzle unit 42, and the gas pressure of controlling the liquid coating materials source, so as to achieve an optimally interspersing and spraying efficiency. In a case, when the nozzle unit 42 and the movable portion 432 are set by the programmable movement apparatus 43 to move in a faster moving velocity, the gas pressure of the first gas-pressure source needed by the nozzle unit 42 and the gas pressure of controlling the liquid coating materials source 60 need to be relatively set higher by the controlling device 45, so as to increase a flow of spraying the liquid coating materials 60; on the contrary, when the moving velocity of both the nozzle unit 42 and the movable portion 432 is set slower by the programmable movement apparatus 43, the gas pressure of the first gas-pressure source needed by the nozzle unit 42 and the gas pressure of controlling the liquid coating materials source need to be relatively set lower by the controlling device 45, so as to lower a flow rate of spraying the liquid coating materials 60, thereby achieving a balance required in the optimally interspersing and spraying efficiency.

In a preferred embodiment of the present invention, a composition of the liquid coating materials 60 comprises hydrofluoroether (with a content of 90~99 wt %) and fluorides (with a content of 1 wt %~10 wt %). In another preferred embodiment of the present invention, a composition of the liquid coating materials 60 comprises styrene-acrylate copolymer (with a content of approximate 28 wt %), polyethylene wax (with a content of approximate 2 wt %), and water, butyl acetate and amine antioxidant (with a combined content of approximate 70 wt %). However, the above-mentioned chemical composition and their contents does not therefore limit a protective scope claimed by the present invention thereto since in other embodiment, the present invention can also employ the other liquid coating materials 60, having different compositions in different contents, which accomplishes the following technical benefits that: when the binding layer 60' formed with the liquid coating materials 60 has a thickness in a thickness range of 20~200 μm, the binding layer 60' conforms to 3~50 standard-abrasive cycles under a standard abrasive-resistance test using a RCA Abrader and defined in ASTM F-2357-04 specification. Generally speaking, one RCA standard-abrasion cycle value is probably equivalent to an abrasion result from the human finger pressing a device and test (such as keypads of a keyboard) for 10,000 times. As accordingly found, the binding layer 60' of the shaped-paper product 106 produced by the product surface coating apparatus 40 of the present invention has a great abradability, without an ease of fuzz with fiber scraps.

As shown in FIG. 7, in a preferred embodiment of the present invention, the surface-coating step S130 further comprises a step S138 which comprises utilizing the drying device 46 of the product surface coating apparatus 40 to heat-dry the liquid coating materials 60 sprayed onto the at least one surface of the at least one shaped-paper body 1042 of the second semi-finished product 104 (as shown in FIGS. 1 and 2), and thereby forming the binding layer 60' of the third semi-finished product 106 (or called 'shaped-paper product'). In this preferred embodiment, a drying temperature of the drying device 46 approaches 100 degrees in a centigrade scale; and preferably, is 60 degrees in the centigrade scale, and its drying cycle time is 20 seconds. However, this does not therefore limit a protective scope claimed by the present invention thereto since in other embodiment, the present invention can also employ the other drying device 46 having different specification.

As shown in FIG. 6, in a preferred embodiment of the present invention, the method for fabricating shaped-paper products further comprises: after implementing the surface-coating step S130, implementing a cutting step S140 which comprises utilizing cutter molds to cut the third semi-finished product 106 (or called 'shaped-paper product'), thereby forming a shaped-paper finished product. However, in other embodiments, depending on different demands for different shaped-paper products, an implementing sequence of the surface-coating step S130 can be altered to implement ahead before the at least one thermo-compression forming step S120 or laggingly behind the cutting step S140.

Figure 8A:
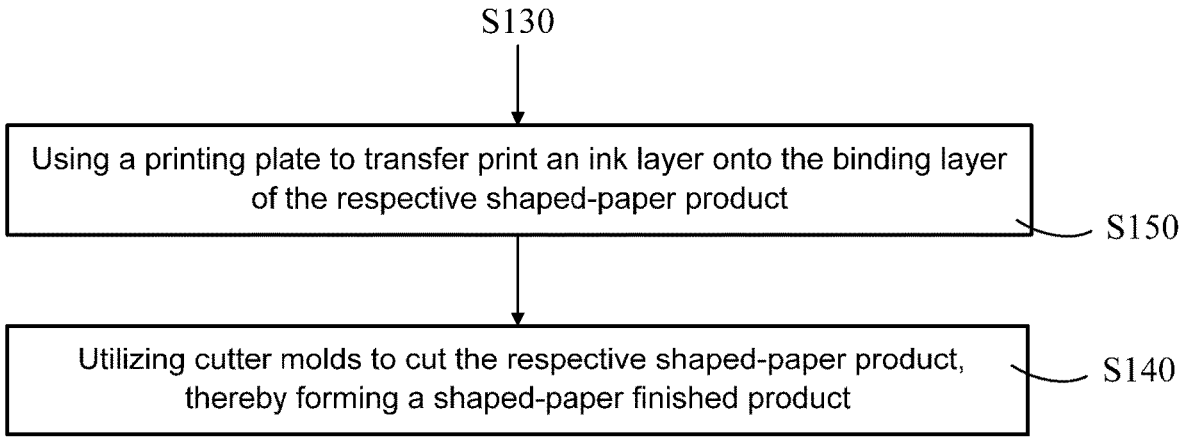
FIG. 8A illustrates a flow chart of a method for fabricating shaped-paper products, in another preferred embodiment according to the present invention.

As shown in FIGS. 4 and 8A, in another preferred embodiment of the present invention, the method for fabricating the shaped-paper products further comprises a step S150 which comprises using the printing plate 90 to transfer print the ink layer 2020 onto the binding layer 60' of the respective shaped-paper product (as shown in FIG. 4), wherein the printing plate 90 is one of an intaglio printing plate, a relief printing plate, a screen printing plate and a planographic printing plate. The method for fabricating shaped-paper products further comprises: implementing the above-mentioned cutting step S140 after implementing the step S150. However, in other embodiments, depending on different demands for different shaped-paper products, an implementing sequence of the above-mentioned cutting step S140 can be altered to implement ahead before the step S150 is implemented.

Figure 8B:
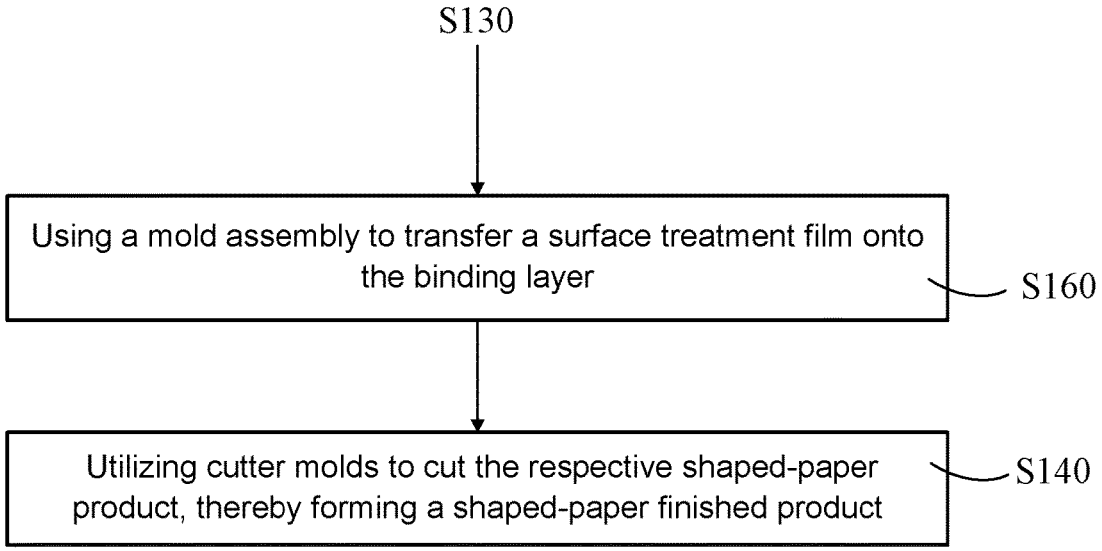
FIG. 8B illustrates a flow chart of a method for fabricating shaped-paper products, in another preferred embodiment according to the present invention.

As shown in FIGS. 5 and 8B, in a preferred embodiment of the present invention, the method for fabricating shaped-paper products further comprises a step S160 of using a mold assembly (not shown) to transfer a surface treatment film 200 onto the binding layer 60' (as shown in FIG. 5). As shown in FIG. 5, the surface treatment film 200 and said shaped-paper product 106' both are put in between the mold assembly such as a pair of convex mold and concave mold, and then the surface treatment film 200 is transferred (or called 'substrate transfer' 1135) by a thermo-compression approach onto the outer surface of the binding layer 60' of the shaped-paper body 1042. In the preferred embodiment as shown in FIG. 5, the surface treatment film 200 primarily comprises: a strippable carrier layer 2060, a release layer 2050 located on a surface of the carrier layer 2060, a hard coating layer 2040 located on a surface of the release layer 2050, at least one ink layer 2020, a decorative layer 2030 located on between the hard coating layer 2040 and the at least one ink layer 2020, and an adhesive layer 2010 located on one of outermost surfaces of the surface treatment film 200 and configured to adhere the surface treatment film 200 onto of the binding layer 60' of the at least one shaped-paper body 1042, wherein the release layer 2050, the hard coating layer 2040, the decorative layer 2030, the at least one ink layer 2020 and the adhesive layer 2010 all are formed sequentially on a lower surface of the carrier layer 2060. After the surface treatment film 200 is adhered by the adhesive layer 2010 onto the outer surface of the binding layer 60', the carrier layer 2060 can be stripped from the surface treatment film 200 of said shaped-paper product 106' by way of an auxiliary o the release layer 2050. The hard coating layer 2040 is capable of protecting the at least one ink layer 2020 and the decorative layer 2030. In this preferred embodiment, the material of the carrier layer 2060 is selected from the group consisting of polyethylene terephthalate (PET), polymethyl methacrylate (PMMA), polycarbonate (PC) and polystyrene (PS); preferably, the carrier layer 30 is constructed of polyethylene terephthalate (PET), a thickness of carrier layer 30 is in a thickness range from of 40 μm to 80 μm. However, this does not therefore limit a protective scope claimed by the present invention thereto.

As shown in FIG. 8B, in a preferred embodiment of the present invention, the method for fabricating shaped-paper products further comprises: implementing the above-mentioned cutting step S140 after implementing the step S160. However, in other embodiments, depending on different demands for different shaped-paper products, an implementing sequence of the above-mentioned cutting step S140 can be altered to implement ahead before the step S160 is implemented.

Compared with the prior arts, the method for fabricating the shaped-paper products according to the present invention is applied with the continuous production machines for the wet-fiber paper-molded process to larger-regionally and rapidly spray the atomized coating material 60 onto the outer surface of the shaped-paper body, thereby forming an evenly-distributed binding layer 60'. This could not only save processing time but can also simultaneously ensure a higher production yield and quality. By the method for fabricating shaped-paper products of the present invention to form the binding layer 60' onto the outer surface of the shaped-paper body 1042 of the shaped-paper product 106, 106', the binding layer 60' could not only decrease the scraps falling off from the outer surface of the shaped-paper product 106, 106' and the possibility of incurring fine dusts, but the binding layer 60' does not easily incur the graphic/text printing distortion matters resulted from the ink halo, the ink penetration and set forth, when the graphic/text printing is made onto the outer surface of the shaped-paper product 106, 106'. Furthermore, the binding layer 60' is capable of enhancing a surface watertightness of the shaped-paper product 106, 106', and elevating the abradability of the outer surface of the shaped-paper product 106, 106'.

As described above, although the present invention comprises been described with the preferred embodiments thereof, those skilled in the art will appreciate that various modifications, additions, and substitutions are possible without departing from the scope and the spirit of the invention. Accordingly, the scope of the present invention is intended to be defined only by reference to the claims.

What is claimed is:

1. A method for fabricating shaped-paper products, comprising:

at least one pulp-dredging step which comprises utilizing both a first upper mold and a first lower mold, either of which is utilized to dredge up paper-slurry materials, containing wet fibers, within a slurry tank, and thereby forming a wet pulp, constructed of the paper-slurry materials, between the first upper mold and the first lower mold;

at least one pre-compression step which comprises implementing a compression on the wet pulp mutually between the first upper mold and the first lower mold in a closing-mold manner, draining a portion of water vapor and/or moistures contained within the wet pulp, and thereby forming a first semi-finished product;

at least one thermo-compression forming step which comprises positioning the first semi-finished product into between a second upper mold and a second lower mold, implementing a thermo-compression forming on the first semi-finished product mutually between the second upper mold and the second lower mold, draining a portion of water vapor and/or moistures contained within the first semi-finished product, and thereby forming a second semi-finished product having a shaped-paper body; and a surface-coating step which comprises employing a product surface coating apparatus to coat the liquid coating materials onto at least one outer surface of the shaped-paper body of the second semi-finished product, for forming the respective shaped-paper product having a binding layer, wherein a composition of the liquid coating materials is selected from a group consisting of hydrofluoroether and fluorides or a group consisting of styrene-acrylate copolymer, polyethylene wax, water, butyl acetate and amine antioxidant, to make a binding layer having an abradability conforming 3~50 standard-abrasive cycles under a standard abrasive-resistance test using a RCA Abrader and defined in ASTM F-2357-04 specification.

2. The method for fabricating the shaped-paper products as claimed in claim 1, wherein the surface-coating step further comprises utilizing a conveying apparatus to movably carry the second semi-finished product to reach the product surface coating apparatus.

3. The method for fabricating the shaped-paper products as claimed in claim 2, wherein the surface-coating step further comprises the at least one sensor generating a notification signal to the programmable movement apparatus and/or the controlling device, for actuating a spraying operation, when sensing that the conveyed second semi-finished product reaches a to-be-sprayed position.

4. The method for fabricating the shaped-paper products as claimed in claim 1, wherein the product surface coating apparatus comprises a programmable movement apparatus which has a movable portion, a nozzle unit disposed with the movable portion, and a controlling device, and the surface-coating step further comprises that when the movable portion is programmably moved, with bringing the nozzle unit together, along a predetermined spraying path and/or in a moving velocity, with relative to the at least one outer surface of the shaped-paper body, the nozzle unit atomization-sprays the liquid coating materials onto the at least one outer surface of the shaped-paper body by adjustable control of the controlling device.

5. The method for fabricating the shaped-paper products as claimed in claim 4, wherein the surface-coating step further comprises employing a drying device to heat-dry the liquid coating materials sprayed on the at least one outer surface of the shaped-paper body of the second semi-finished product, and thereby forming the binding layer of the respective shaped-paper products.

6. The method for fabricating the shaped-paper products as claimed in claim 1, wherein a thickness of the binding layer is in a thickness range of 20~200 μm.

7. The method for fabricating the shaped-paper products as claimed in claim 1, further comprising transfer-printing an ink layer onto the binding layer of the respective shaped-paper products by a printing plate wherein the printing plate is one of an intaglio printing plate, a relief printing plate, a screen printing plate and a planographic printing plate.

8. The method for fabricating the shaped-paper products as claimed in claim 1, further comprising transferring a surface treatment film onto the binding layer by a mold assembly.

9. The method for fabricating the shaped-paper products as claimed in claim 8, wherein the surface treatment film comprises:

a strippable carrier layer;

a release layer located on a surface of the carrier layer;

a hard coating layer located on a surface of the release layer;

a decorative layer located on a surface of the hard coating layer;

at least one ink layer; and an adhesive layer located on one of outermost surfaces of the surface treatment film, for adhesion onto the binding layer of the respective shaped-paper products.

10. The method for fabricating the shaped-paper products as claimed in claim 1, further comprising a cutting step that utilizes cutter molds to cut the respective shaped-paper product, for forming a shaped-paper finished product.

* * * * *